United States Patent [19]

Raugulis et al.

[11] 4,161,144

[45] Jul. 17, 1979

[54] RESTRAINT MEANS FOR OVERHEAD TRAVELLING CRANE

[75] Inventors: Indulis E. Raugulis, Shorewood; Craig D. Dewey, Menomonee Falls; Richard H. Gundrum, New Berlin, all of Wis.

[73] Assignee: Harnischfeger Corporation, West Milwaukee, Wis.

[21] Appl. No.: 881,524

[22] Filed: Feb. 27, 1978

[51] Int. Cl.[2] ..... B61F 7/00

[52] U.S. Cl. ..... 105/163 R; 104/247; 104/248; 212/10

[58] Field of Search ..... 212/10; 104/244–248, 104/98; 105/163, 216, 217

[56] References Cited

U.S. PATENT DOCUMENTS

| | | | |
|---|---|---|---|
| 1,442,194 | 1/1923 | Thomas | 104/248 |
| 1,944,054 | 6/1934 | Ackerman | 104/247 |
| 3,707,125 | 12/1972 | Milenkovic et al. | 104/247 X |

*Primary Examiner*—Robert G. Sheridan
*Attorney, Agent, or Firm*—James E. Nilles

[57] ABSTRACT

An overhead travelling crane for a structure subject to oscillations resulting from earthquake shocks, comprises a bridge having flanged main wheels at opposite ends which are supported on a circular runway rail attached to the structure. Restraint means are provided between each end of the crane bridge and the structure to damp or control horizontal shifting of the crane relative to the structure resulting from horizontal oscillations of the structure to thereby prevent damage to the flanged main wheels and runway rail and crane derailment. The restraint means comprise a pair of shock absorber assemblies, one mounted at each end of the crane bridge, which are in constant resilient engagement with the sides of the structure and prevent a gap or space from occurring which would allow for excessive accelerated movement of the crane bridge. Each shock absorber assembly comprises a support bracket connected to the bridge, a pair of snubber wheel support plates pivotally mounted on the support bracket, a pair of rotatable snubber wheels, one mounted on each wheel support plate, and rotatably engaged with the structure (or a guide rail) thereon, biasing means connected between the snubber wheel support plates for urging the snubber wheels toward the structure, and a shock absorber connected between the snubber wheel support plates for controlling or damping movement of the snubber wheels away from the structure.

17 Claims, 10 Drawing Figures

RESTRAINT MEANS FOR OVERHEAD TRAVELLING CRANE

BACKGROUND OF THE INVENTION

1. Field of Use

This invention relates generally to overhead travelling cranes. In particular, it relates to restraint means connected between the crane and its supporting structure to dampen relative shifting movement of the crane and thereby prevent crane derailment as the structure oscillates from earthquake shocks or the like.

2. Description of the Prior Art

Some overhead travelling cranes comprise an elongated bridge, a trolley-mounted hoist movable along the bridge, and main wheels (some power driven) mounted at opposite ends of the bridge and engaged with runway rails which are mounted on a supporting structure. in some cases, the runway rails are parallel and the crane moves in a straight path therealong. In other cases, as in some atomic power plants, a single circular runway rail is provided and the crane either rotates about or moves around a central point, depending on the spacing between the peripheral locations where the main wheels engage the rail. Usually, the main wheels are single or double-flanged to ensure engagement with the associated runway rail, although some wheels are unflanged and auxiliary side wheels or rollers are employed to keep the main wheels aligned with the runway rail.

In any case, if the structure on which the crane is mounted is subjected to horizontal oscillation resulting from heavy shocks caused by earthquakes, explosions, or other events, there is relative shifting movement between the structure and the crane which can result in crane derailment and damage to the main wheels and runway rails, even if flanged wheels or auxiliary side wheels or rollers are employed, thereby rendering the crane inoperative. In atomic power plants, the danger is aggravated if derailment or damage occurs while radioactive materials or components are being transported. The relative horizontal shifting between the crane and its supporting structure can occur because the force of the shock is great, the mass of the crane is quite large, and the crane wheels merely rest on the runway rails. Typically, the main wheel flanges or auxiliary side wheels or rollers are not strong enough to withstand breakage as they are thrust against the side of a runway rail. Furthermore, since the forces are large, the use of stronger flanges would then result in damage to the runway rails. For example, in a typical atomic power plant wherein the circular runway rail has a diameter of about 134 feet (and a corresponding bridge length and size), the structure could oscillate at a frequency of about 3 to 5 Hz (in simple harmonic motion) and could deflect horizontally as much as $\pm 0.53$ inches relative to the crane at a velocity of up to 30.6 inches per second at the 5 Hz frequency during an earthquake. A crane of such size and corresponding weight would exert total horizontal forces on the order of 423,000 pounds, for example, which would be distributed between the main wheel flanges and the runway rail. In view of the large relative movements and forces acting between the crane and the structure on which it is mounted during shocks from earthquakes or other causes, and the possible dangers therefrom, it is desirable to provide restraint means to dampen or control horizontal shifting movement of the crane relative to the structure and thereby prevent derailment and wheel and runway damage.

The following patents exemplify some prior art apparatus intended to maintain alignment between the main wheels of overhead travelling cranes and the runway rails therefor under various circumstances: U.S. Pat. No. 3,095,829; U.S. Pat. No. 1,758,580; West German Pat. No. 1,531,277; and U.S.S.R. Pat. No. 3 96 299. The prior art shows that one or two flanges have been used on a main wheel to maintain registration with a runway rail. The prior art also teaches the use of auxiliary wheels or rollers which ride on the side of a runway rail or separate guide rail to maintain wheel alignment. However, the prior art does not teach the concept of dampening or controlling shifting movement of the crane relative to the structure or overhead travelling cranes able to withstand derailment or damage during heavy earthquake shocks.

SUMMARY OF THE PRESENT INVENTION

In accordance with the invention, there is provided an overhead travelling crane for use on a structure subject to oscillations resulting from earthquake shocks or the like. The crane comprises a bridge having flanged main wheels at opposite ends which are supported on a circular runway rail attached to the structure. Restraint means are provided between each end of the crane bridge and the structure to damp or control horizontal shifting of the crane relative to the structure resulting from horizontal oscillations of the structure to thereby prevent damage to the flanged main wheels and runway rail and crane derailment. The restraint means comprise a pair of shock absorber assemblies, one mounted at each end of the crane bridge, which are in constant resilient engagement with the sides of the structure and prevent a gap or space from occurring which would allow for excessive accelerated movement of the crane bridge. Each shock absorber assembly comprises: a support bracket connected to the bridge near an end thereof; a pair of snubber wheel support plates pivotally mounted on an associated support bracket; a pair of rotatable snubber wheels, one mounted on each snubber wheel support plate, and rotatably engaged with the structure (or a guide rail thereon); biasing means in the form of a coiled compression spring connected to act between the pair of snubber wheel support plates for resiliently urging the snubber wheels toward and into engagement with the structure (or the guide rail thereon); and a shock absorber connected between the pair of snubber wheel support plates for controlling or damping movement of the snubber wheels away from the structure (or the guide rail thereon) so that the snubber wheels are always maintained in engagement with the structure (or the guide rail thereon) by the biasing means and prevent any gap from occurring. Preferably, the shock absorber comprises two relatively movable components and the biasing means takes the form of a compression or return spring connected between those two relatively movable components.

Preferably, uplift restraint means are also provided to limit vertical movement of the crane relative to the structure resulting from vertical oscillations of the structure. The uplift restraint means comprises a restraint member connected to said bridge near one end thereof and spaced from but engageable with the aforementioned guide rail when the main wheel is uplifted relative to the runway rail.

In operation, the snubber wheels on each end of the bridge are forced to ride against the guide rail by the return spring mounted on the shock absorber. In an embodiment of the invention wherein the diameter of the circular runway rail was about 134 feet, wherein the crane weighed about 812,000 pounds, and wherein a maximum restraint force of about 423,000 $Lb_f$ was contemplated, the force of the return spring varied from about 750 $Lb_f$ to 3300 $Lb_f$, with 2000 $Lb_f$ being the nominal value. The extra force (damping, from the shock absorber) was about 500 $Lb_f$ for normal crane movement at rated speed of about 50 feet per minute. Also, in a preferred embodiment, the shock absorber was of a type disclosed in U.S. Pat. No. 3,722,640, which issued Mar. 27, 1973 to Paul H. Taylor and entitled "Fluid Amplified Liquid Spring Shock Absorbers with Improved Piston Heads."

During earthquake conditions, assuming maximum earthquake restraint force of about 423,000 $Lb_f$, a structure oscillation frequency of about 3 to 5 Hz, a maximum building deflection of about $\pm 0.53$ inch, and a maximum building velocity of about 30.6 inches/second at 5 Hz, the main wheels are considered to displace $\pm \frac{1}{4}$ inch horizontally relative to the runway rail, due to the 211,500 $Lb_f$ at each wheel (423,000 $Lb_f$ total). This force is transmitted to the shock absorber through the linkage including the snubber wheels and pivot plates. The shock absorber is single acting and requires the external biasing spring to keep the snubber wheels in contact with the guide rail during the stroke return to allow the main wheels to follow the structure motion.

Restraint means in accordance with the invention offer numerous advantages, such as applicability to overhead travelling cranes which are supported and travel on a circular runway rail or on a pair of spaced apart parallel runway rails, or to cranes which employ a bridge which has one end pivotally anchored and its other wheeled end associated with a curved runway rail.

The restraint means in accordance with the invention and the upward restraint means, could be used independently of each other on a crane, if required, although both cooperate to provide more complete protection.

Shock absorber means in accordance with the invention are effective to dampen or control relative shifting movement of the crane relative to the structure and thereby prevent derailment.

Restraint means in accordance with the invention, which are relatively economical and easy to fabricate and use readily available components, such as steel plate, steel wheels, steel pivot pins, and commercially available hydraulic shock absorbers and compression springs, can be installed on many types of cranes, either during manufacture or as a retrofit.

Furthermore, restraint means in accordance with the invention are relatively compact in form and size, considering the overall size of the structure and the crane and the magnitude of the weights and forces involved.

In the embodiment disclosed, the restraint means are shown as acting against a guide rail mounted on the structure but it is to be understood that they could act directly against the structure wall itself if a sufficiently smooth and strong path were provided. Also, if preferred, the runway rail and guide rail could be combined in a single structural component.

Other objects and advantages of the invention will hereinafter appear.

DESCRIPTION OF A PREFERRED EMBODIMENT

Figure 3:
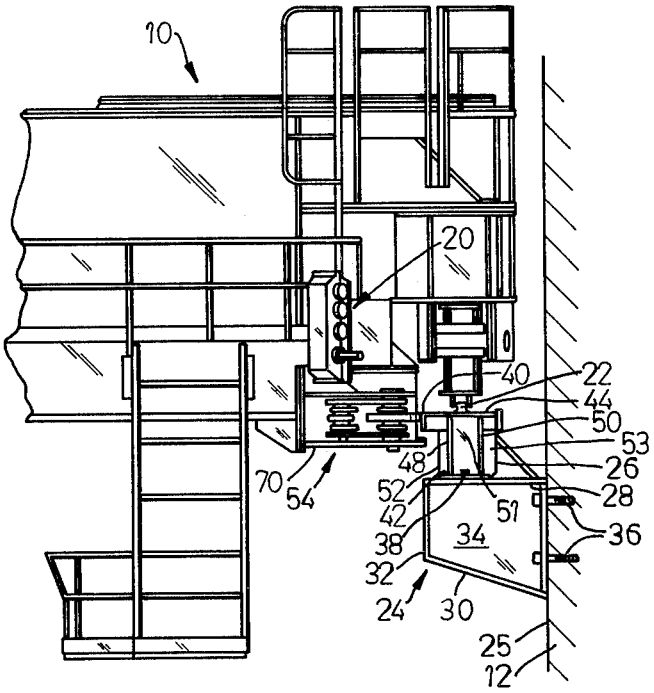
FIG. 3 is an enlarged side elevation of the portion of the end of the crane shown in FIG. 2.
Figure 2:
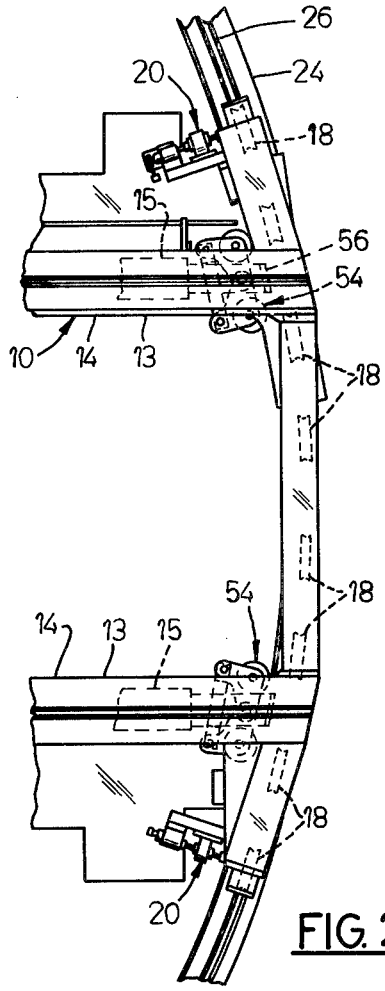
FIG. 2 is an enlarged top plan view of a portion of one end of the crane and structure of FIG. 1.
Figure 1:
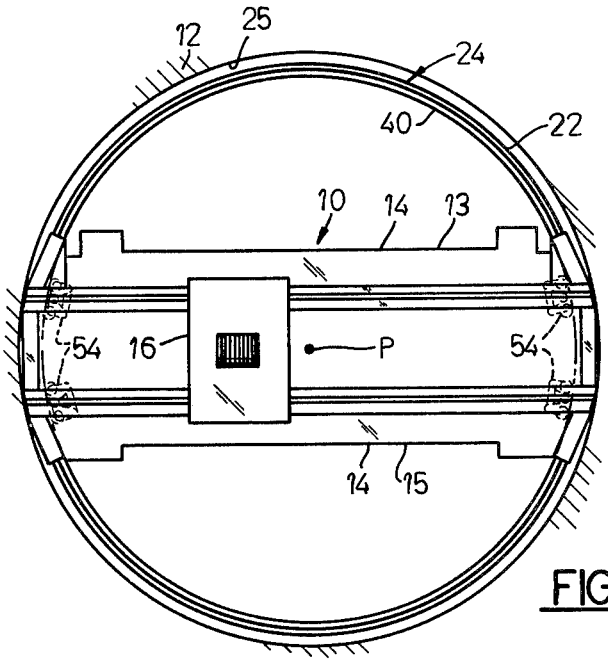
FIG. 1 is a top plan view showing an overhead travelling crane having restraint means in accordance with the invention mounted on a circular structure.
Figure 7:
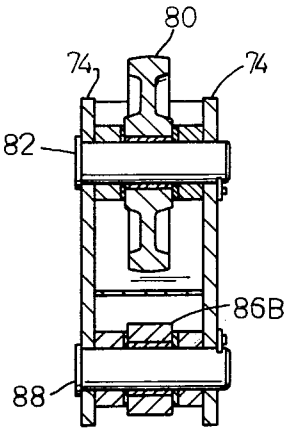
FIG. 7 is a cross-section view taken on line 7—7 of FIG. 5.

Referring to FIGS. 1, 2, and 3, the numeral 10 designates an overhead travelling crane used in a structure 12 subject to oscillations resulting from earthquake shocks or the like. Crane 10 comprises an elongated bridge 14, a trolley-mounted hoist 16 which can run back and forth along the length of the bridge, and a plurality of double-flanged main wheels 18 (some of which are power driven as by drive assemblies 20, shown in FIG. 2) located at or near opposite ends of the bridge and which engage and ride on a runway rail 22 mounted on the structure 12 in which the crane is used. Bridge 14 comprises two spaced apart bridge girders 13 which are joined at their ends by end girders 15. Structure or building 12 may be assumed to be, for example, an atomic reactor or power plant, which is circular, and the runway rail 22 takes the form of a continuous circular runway rail around which the crane 10 travels, rotating about a central point P, as a result of the spacing between the peripheral locations on the circular runway rail where the opposite main wheels 18 engage the runway rail. Runway rail 22 is supported on structure 12 by means of a support 24 which is rigidly secured to the inside surface of the circular side wall 25 of structure 12 and which is fabricated, for example, of sheet steel plates, including an upper plate 28, a lower plate 30, a side plate 32, and spaced apart gusset plates 34, all of which are appropriately secured together by welding and secured to wall 25 as by bolts 36. Support 24 further includes a box girder assembly 26 which is rigidly mounted on upper plate 28 as by bolts 38 and directly supports runway rail 22 and a circular guide rail 40, hereinafter described. Box girder assembly 26 comprises a lower plate 42, a relatively wide upper plate 44 on which runway rail 22 is rigidly mounted as by bolts 46, a pair of spaced apart inner and outer side plates 48 and 50, and suitable spaced apart gussets 51, 52, 53, all of which are appropriately secured together by welding.

If the structure 12 is subjected to either horizontal or vertical oscillations or both, caused by heavy shocks from earthquakes, explosions, or other causes, there is danger of the crane 10 being thrown partially or completely off its supporting runway rail 22, thereby becoming inoperative, or damaged, or actually falling. For example, in the embodiment shown, the circular runway rail 22 has a diameter of about 134 feet (and a corresponding bridge length and size), the structure could oscillate at a frequency of about 3 to 5 Hz (in simple harmonic motion) and could deflect horizontally as much as ±0.53 of an inch relative to the crane at a velocity of up to 30.6 inches per second at the 5 Hz frequency during an earthquake. A crane of such size and corresponding weight would exert total horizontal forces on the order of 423,000 pounds, for example, which would be distributed between the main wheel flanges and the runway rail.

In view of the large relative movements and forces acting between the crane 10 and the structure 12 on which it is mounted during shocks from earthquakes or other causes, and the possible dangers therefrom, restraint means are provided to dampen or control shifting of the crane relative to the structure thereby preventing derailment and wheel/rail damage or both and to thereby ultimately maintain horizontal registration or alignment between the main wheels 18 and runway rail 22.

The restraint means comprise the circular guide rail 40, hereinbefore referred to, which is mounted on the structure 12 by support 26 concentrically inwardly of the circular runway rail 22 and shock absorber means or assemblies 54 mounted on the bridge ends for cooperation with the circular guide rail 40.

Figure 4:
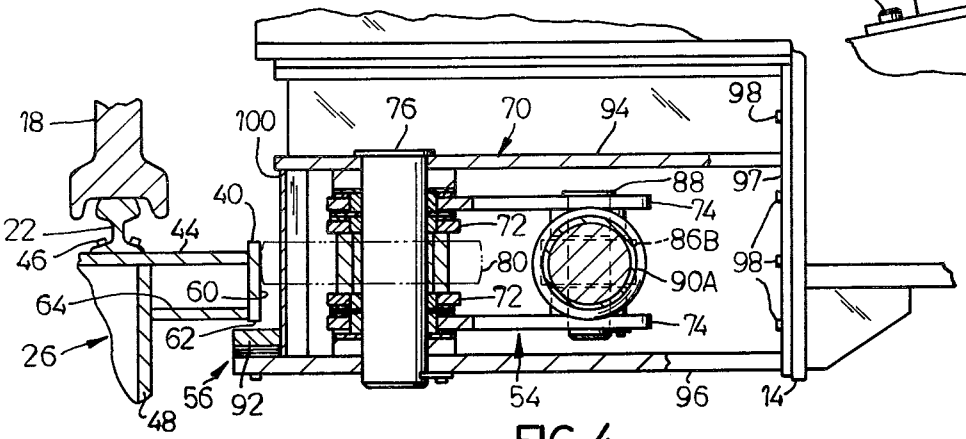
FIG. 4 is an enlarged cross-section view of restraint means in accordance with the invention taken on line 4—4 of FIG. 2.
Figure 8:
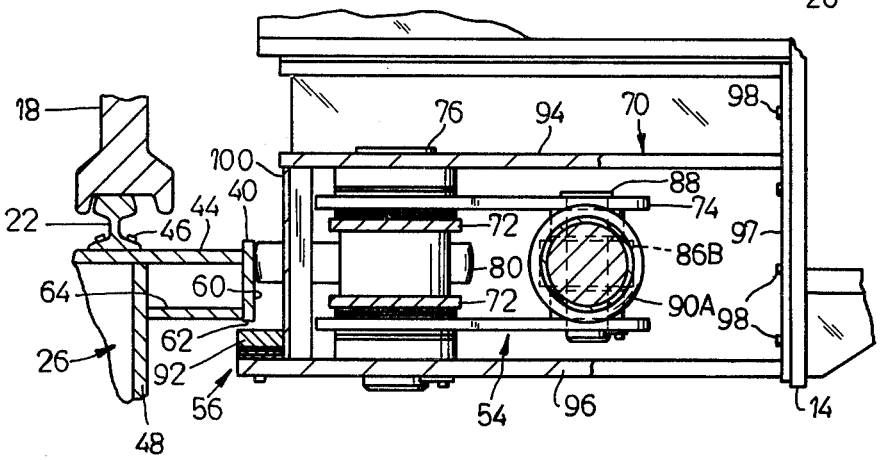
FIG. 8 is a view similar to FIG. 4 but showing another position assumed by the shock absorber means of the wheel restraint means when the crane shifts horizontally relative to the structure.

Circular guide rail 40, which is fabricated of steel plate, is provided with a vertically disposed inner surface 60 for cooperation with the shock absorber assemblies 54 and with a lower edge 62 for cooperation with the uplift restraint means 56. The outer surface of guide rail 40 is edge-welded to the inner edge of upper plate 44 of box girder assembly 26 and is also edge-welded to the inner edge of a ring-like plate 64 whose outer edge is welded to inner side plate 48 of box girder assembly 26, as FIGS. 3, 4, and 8 show.

The shock absorber assemblies 54, four of which are shown in FIG. 1, and the uplift restraint means 56, four of which are provided, prevent horizontal and vertical displacement, respectively, of the main wheels 18 relative to the runway rail 22 resulting from horizontal and vertical oscillations of the structure 12.

Each shock absorber assembly 54 comprises a support structure 70 whereby it is attached to an end of bridge 14, a pair of pivot members or plates 72 and 74 pivotally mounted on the support structure 70 by means of a common pivot pin 76, a pair of snubber wheels 78 and 80, each snubber wheel 78, 80 being rotatably mounted on one of the pivot members 72, 74 by an axle pin 82, biasing means in the form of a coiled compression-type return spring 84 for biasing the wheels toward the guide rail 40, and a shock absorber 86 connected between the pair of pivot members 72 and 74 by pivot pins 88 for controlling movement of the snubber wheels 78, 80 away from the guide rail 40. The shock absorber 86 comprises two relatively movable components 86A and 86B and the return spring 84 surrounds and is connected between those two relatively movable components, acting against flanges 90A and 90B thereon.

Support structure 70 of the shock absorber assembly 54 comprises an upper plate 94, a lower plate 96, an inner end plate 97 secured to bridge 14 by bolts 98, and an outer end plate 100, all of which are suitably welded to form the support structure. Lower plate 96 projects beyond outer end plate 100 and provides support for a restraint member 92 which is welded to the upper surface thereof.

Figure 6:
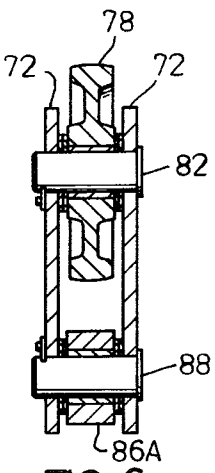
FIG. 6 is a cross section view taken on line 6—6 of FIG. 5.

Each uplift restraint assembly 56 comprises the restraint member 92 which is mounted on a bridge end on support structure 70 below and spaced from the lower edge 62 of the guide rail 40 which engages the guide rail at edge 62 to limit the travel of the main wheels 18 as they are lifted vertically relative to the circular runway rail during vertical oscillation of the structure, as FIG. 6 shows. Preferably, the restraint member 92 of the uplift restraint assembly 56 is connected to or made integral with the support structure 70 for the associated shock absorber assembly 54, as FIG. 4 shows.

Operation

In operation, the snubber wheels 78 and 80 on each shock absorber assembly 54 on each end of the girder 14 are forced to ride on the guide rail 40 by the return spring 84 mounted on the shock absorber 86. In an embodiment of the invention wherein the diameter of the circular runway rail was about 134 feet, wherein the crane weighed about 812,000 pounds, and wherein a maximum restraint force of about 423,000 $Lb_f$ was contemplated, the force of the return spring varied from about 750 $Lb_f$ to 3300 $Lb_f$, with 2000 $Lb_f$ being the nominal value. The extra force (damping, from the shock absorber) was about 500 $Lb_f$ for normal crane movement at rated speed of about 50 feet per minute.

Figure 5:
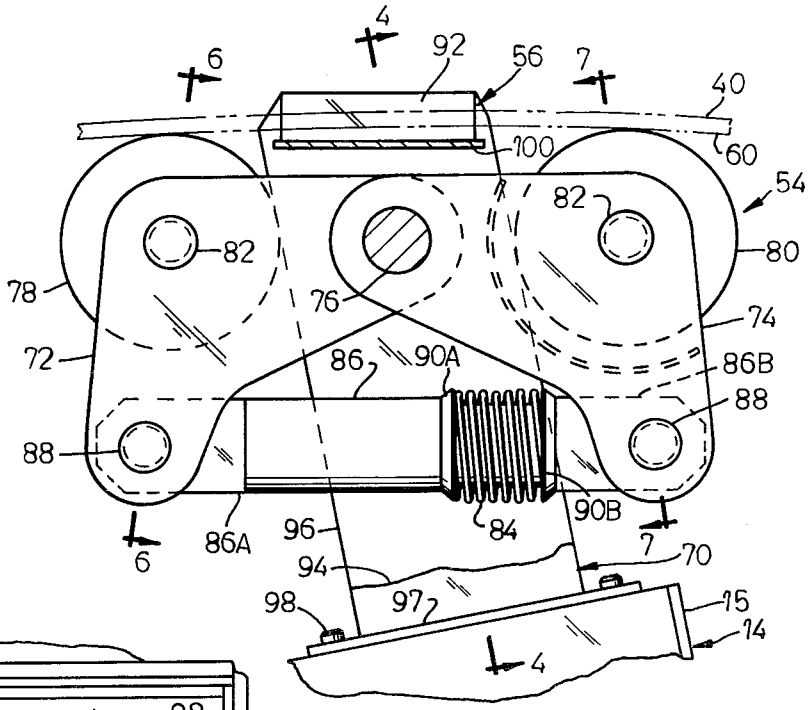
FIG. 5 is an enlarged top plan view of the restraint means shown in FIGS. 1 through 4.
Figure 9:
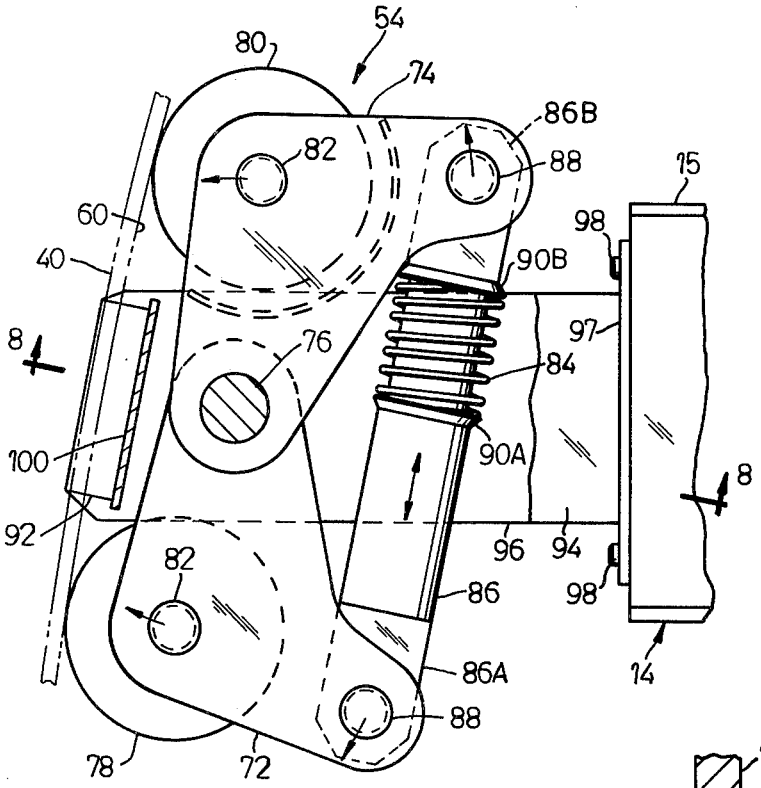
FIG. 9 is a view similar to FIG. 5 but showing another position assumed by the shock absorber means of the wheel restraint means when the crane shifts horizontally relative to the structure.
Figure 10:
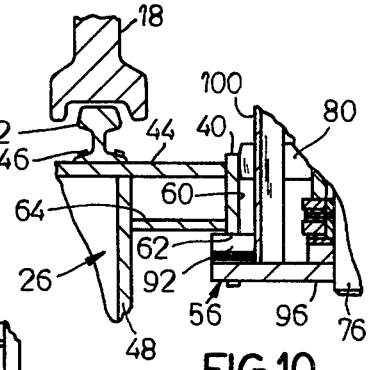
FIG. 10 is a view similar to FIG. 8 but showing another position assumed by the uplift restraint means when the crane shifts vertically relative to the structure.

Under no-shock conditions, the main wheels 18 are centered on runway rail 22 and the restraint means assume the positions shown in FIGS. 4 and 5. During earthquake conditions, assuming maximum earthquake restraint force of about 423,000 $Lb_f$, a structure oscillation frequency of about 3 to 5 Hz, a maximum building deflection of about ±0.53 of an inch, and a maximum building velocity of about 30.6 inches/second at 5 Hz, the main wheels 18 are considered to displace $\pm\frac{1}{4}$ inch horizontally relative to the runway rail 22, due to the 211,500 $Lb_f$ at each wheel (423,000 $Lb_f$ total), as FIGS. 8 and 9 show. This force is transmitted to the shock absorber 86 through the linkage including the snubber wheels 78, 80 and pivot plates 72, 74. The shock absorber 86 is single acting and requires the external biasing spring 84 to keep the snubber wheels 78, 80 in contact with the surface 60 of the guide rail 40 during the return stroke to allow the main wheels 18 to follow the horizontal motion of structure 12.

As a result of the foregoing arrangement, the snubber wheels 78 and 80 at each end of the crane bridge are always in contact with the guide rail 40 (which guide rail 40 is in effect a part of the building or structure wall). Thus, since there is no gap between the ends of the crane bridge and the walls of the structure, the crane is unable to accelerate unduly rapidly with respect to the structure as it moves relative thereto. Thus, the forces transmitted horizontally between the main wheels of the crane and the runway rail 22 are substantially reduced, as compared to the magnitude of the forces which would exist if the crane were completely free to accelerate along the bridge axis during a shock.

As a result, damage to the runway rail and to the wheel flanges is elminated and derailment of the crane is prevented. As will be understood, in the embodiment shown, the snubber wheels 78 and 80 preferably ride along a smooth prepared surface such as guide rail 40 which is an effective part of the building structure. However, if suitable provisions were made therefor, the snubber wheels could ride directly against the wall of the structure or against a guide rail located or disposed or constructed differently than shown.

We claim:

1. In combination:

a structure subject to oscillation resulting from shocks;

a crane supported on said structure;

and restraint means connected to said crane and in constant resilient engagement with said structure to control shifting movement of said crane relative to said structure resulting from said oscillations, said restraint means comprising:

a movable member connected to said crane;

biasing means for urging said movable member generally horizontally against said structure;

and a shock absorber connected to said movable member for controlling movement of said movable member away from said structure whereby said biasing means maintains said movable member in constant engagement with said structure.

2. The combination according to claim 1 wherein said movable member is a rotatable snubber wheel.

3. In combination:

a structure subject to oscillation resulting from shocks;

a crane supported on said structure;

and restraint means connected to said crane and in constant resilient engagement with said structure to control shifting movement of said crane relative to said structure resulting from said oscillations;

said restraint means comprising a support connected to said crane, a pair of pivot members pivotally mounted on said support, a snubber wheel rotatably mounted on each of said pivot members, biasing means connected to said pivot members for urging said snubber wheels generally horizontally against said structure, and a shock absorber connected to said pair of pivot members to prevent disengagement of said snubber wheels from said support structure.

4. A combination according to claim 3 wherein said shock absorber comprises two relatively movable components and wherein said biasing means is connected between said two relatively movable components.

5. A combination according to claim 4 including a pivot pin on said support on which said pair of pivot members are pivotally mounted.

6. In combination:

a structure subject to oscillation resulting from shocks;

a travelling crane having opposite ends;

first means for supporting one end of said crane on said structure;

second means for supporting the other end of said crane on said structure, said second means including a runway rail on said structure and at least one main wheel on said crane rotatably engaged with said runway rail;

and resilient means connected near said other end of said crane and in constant resilient engagement with said structure to control shifting movement of said crane relative to said structure resulting from said oscillations, said restraint means comprising:

a movable member connected to said bridge;

biasing means for urging said movable member generally horizontally against said structure;

and a shock absorber connected to said movable member for controlling movement of said movable member away from said structure whereby said biasing means maintains said movable member in constant engagement with said structure.

7. The combination according to claim 6 wherein said movable member is a rotatable snubber wheel.

8. A combination according to claim 6 wherein said restraint means comprises a support connected to said crane, a pair of pivot members pivotally mounted on said support, a snubber wheel rotatably mounted on each of said pivot members, biasing means connected to said pivot members for urging said snubber wheels against said structure, and a shock absorber connected to said pair of pivot members to prevent disengagement of said snubber wheels from said support structure.

9. A combination according to claim 8 wherein said shock absorber comprises two relatively movable components and wherein said biasing means is connected between said two relatively movable components.

10. A combination according to claim 9 including a pivot pin on said support on which said pair of pivot members are pivotally mounted.

11. In combination:

a structure subject to oscillation resulting from shocks;

a travelling crane having opposite ends;

main wheels at said opposite ends of said crane;

runway rail means on said structure engaged by said main wheels;

and restraint means connected near opposite ends of said crane and in constant resilient engagement with said structure to control shifting movement of said crane relative to said structure resulting from said oscillations, each restraint means comprising:

a movable member connected to said bridge;

biasing means for urging said movable member generally horizontally against said structure;

and a shock absorber connected to said movable member for controlling movement of said movable member away from said structure whereby said biasing means maintains said movable member in constant engagement with said structure.

12. A combination according to claim 11 wherein each restraint means comprises:

a rotatable snubber wheel.

13. In combination:

a structure subject to oscillation resulting from shocks;

a travelling crane having opposite ends;

main wheels at said opposite ends of said crane;

runway rail means on said structure engaged by said main wheels;

and restraint means connected near opposite ends of said crane and in constant resilient engagement with said structure to control shifting movement of said crane relative to said structure resulting from said oscillations;

each restraint means comprising a pair of movable and rotatable snubber wheels connected to said crane and engaged with said structure, biasing means for biasing said wheels generally horizontally toward said structure, and a shock absorber for controlling movement of said wheels away from said structure.

14. A combination according to claim 13 wherein each restraint means further comprises a support and a pair of pivot members pivotally mounted on said support, and wherein each of said snubber wheels is rotatably mounted on one of said pivot members, and wherein said shock absorber is connected between said pair of pivot members.

15. A combination according to claim 14 wherein said shock absorber comprises two relatively movable components and wherein said biasing means is connected between said two relatively movable components.

16. A combination according to claim 14 including a pivot pin on said support on which said pair of pivot members are pivotally mounted.

17. In combination:

a structure subject to oscillation resulting from shocks;

a travelling crane having opposite ends;

main wheels at said opposite ends of said crane;

runway rail means on said structure engaged by said main wheels;

restraint means, including biasing means and shock absorber means and a movable member connected thereto, connected near opposite ends of said crane and arranged so that said movable member is in constant resilient engagement with said structure to control generally horizontal shifting movement of said crane relative to said structure resulting from said oscillations; and uplift restraint means to limit vertical movement of said main wheels relative to said runway rail means resulting from vertical oscillations of said structure, said uplift restraint means comprising a restraint member connected near at least one end of said crane and spaced from but engageable with a portion connected to said structure when an associated main wheel is uplifted relative to said circular runway rail.

* * * * *